US011225939B2

(12) United States Patent
Bengtsson et al.

(10) Patent No.: US 11,225,939 B2
(45) Date of Patent: Jan. 18, 2022

(54) SPARK PLUG EXTENSION

(71) Applicant: SEM AB, Amal (SE)

(72) Inventors: Jorgen Bengtsson, Svanskog (SE); Bert Gustafsson, Amal (SE); Mats Andren, Karlstad (SE)

(73) Assignee: SEM AB, Amal (SE)

( * ) Notice: Subject to any disclaimer, the term of this patent is extended or adjusted under 35 U.S.C. 154(b) by 115 days.

(21) Appl. No.: 16/624,465

(22) PCT Filed: Jun. 12, 2018

(86) PCT No.: PCT/EP2018/065461
§ 371 (c)(1),
(2) Date: Dec. 19, 2019

(87) PCT Pub. No.: WO2018/234095
PCT Pub. Date: Dec. 27, 2018

(65) Prior Publication Data

US 2020/0124015 A1 Apr. 23, 2020

(30) Foreign Application Priority Data

Jun. 19, 2017 (SE) ..... 1750783-1

(51) Int. Cl.
*H01T 13/04* (2006.01)
*F02P 3/02* (2006.01)
(Continued)

(52) U.S. Cl.
CPC ..... *F02P 3/02* (2013.01); *H01T 13/04* (2013.01); *H01T 13/38* (2013.01); *H01T 21/02* (2013.01)

(58) Field of Classification Search
CPC ..... H01T 13/04; H01T 13/38
(Continued)

(56) References Cited

U.S. PATENT DOCUMENTS 5,357,233 A 10/1994 Wada
2008/0218053 A1* 9/2008 Callahan ..... H01T 13/08 313/143
2014/0328002 A1 11/2014 Silva et al.

FOREIGN PATENT DOCUMENTS

CN 1341982 A 3/2002
CN 201265474 Y 7/2009
(Continued)

OTHER PUBLICATIONS

Chinese Office Action from CN Application No. 2018800482015 dated Dec. 8, 2020, 6 pages, 2 page partial English translation.
(Continued)

*Primary Examiner* — Christopher M Raabe
(74) *Attorney, Agent, or Firm* — Brundidge & Stanger, P.C.

(57) ABSTRACT

The present invention relates to a spark plug extension body connecting an ignition coil with a spark plug for a spark ignited internal combustion engine, as well as a method for providing such a spark plug extension body for reduction of partial electrical discharges in the spark plug extension body. In conventional spark plug extensions are coil springs used as electrical conductor against the spark plug terminal and/or ignition coil terminal. These coil springs cause Corona effects and short circuiting requiring replacement of the spark plug extension. With the invention the entire electrical conductor ($CR_u$, 64, $CR_L$) is in a rod like form and at least both ends ($CR_u$, $CR_L$) of the electrical conductor ($CR_u$, 64, $CR_L$) are made as a monolith in a flexible and electrically conducting polymeric material, preferably electrically conducting rubber.

15 Claims, 4 Drawing Sheets

(51) Int. Cl.
*H01T 13/38* (2006.01)
*H01T 21/02* (2006.01)

(58) Field of Classification Search
USPC ..... 123/634
See application file for complete search history.

(56) References Cited

FOREIGN PATENT DOCUMENTS

| | | | |
|---|---|---|---|
| CN | 205618283 | U | 10/2016 |
| EP | 0406509 | A1 | 1/1991 |
| EP | 2234225 | A1 | 9/2010 |
| GB | 2311663 | A | 10/1997 |
| JP | 2003257754 | A | 9/2003 |
| JP | 2006173466 | A | 6/2006 |
| WO | 2005117220 | A2 | 12/2005 |
| WO | 2008/109803 | A1 | 9/2008 |
| WO | 2008109803 | A1 | 9/2008 |
| WO | 2013172771 | A1 | 11/2013 |

OTHER PUBLICATIONS

International Search Report from International Application No. PCT/EP2018/065461 dated Jul. 24, 2018.

* cited by examiner

SPARK PLUG EXTENSION

TECHNICAL FIELD

The present invention relates to a spark plug extension body connecting an ignition coil with a spark plug for a spark ignited internal combustion engine where said spark plug extension body is configured for insertion in a spark plug well.

BACKGROUND ART

Spark ignited internal combustion engines comprise spark plugs for initiating combustion driving the engine piston and require a spark to ignite the fuel-air mixture in the combustion chambers. Conventionally an ignition coil transforms the battery's low voltage to high voltage needed to create an electric spark in the spark plug gaps to ignite the fuel-air mixture. Common for all spark plugs is that they are arranged to be fitted into a well on the cylinder head piercing the wall of the combustion chamber so that the ignition gap of the spark plug is brought into contact with the interior of the combustion cylinder.

Direct ignition systems, where the ignition coil is mounted directly above each spark plug, are known to be advantageous since they eliminate the need of spark-plug wires and reduces leakage current as well as it makes ignition timing-control easier. Such a system is disclosed in EP0987435. These direct ignition systems are usually made up as one integrated assembly comprising both the spark plug as well as the ignition coil, whereby the spark plug is connected to the coil via an interconnecting extension body. The length and shape of the extension body in its turn is dependent on the dimensions of the motor and available positions to mount the ignition coil. Spark ignited engines are sometimes designed with a vast distance (often at least 150 mm, sometimes as much as 500 mm) between the upper portion of the engine head and the internal combustion cylinder leading to long high voltage conductors in order to transmit the ignition voltage from the ignition coil to the spark plug via said extension body.

In some cases this is due to that the spark ignited engine originates from a converted diesel engine. As a diesel engine lacks spark plugs they are not designed to accommodate any spark plug, nor mounting of any ignition coil. Nevertheless, converting diesel engines into spark ignited engines represent a fast growing area, partly due to an increasing environmental awareness, and the ability of converting a diesel engine leads to the possibility of adapting vehicles already in use (e.g. lorry trucks, city busses etc.) to become e.g. gas-compatible. Converting diesel engines are preferred due to high compression ratio and more efficient combustion.

U.S. Pat. No. 5,357,233 discloses an ignition apparatus for an internal combustion engine for providing a peaked high voltage current from an ignition coil to a spark plug through a bendable extension device including a first portion extending from the ignition coil, a second portion adapted to be connected to the spark plug and an elastic member connecting the first member to the second member so that the first member moves elastically in relation to the second member.

EP,A,2.850.315 (=US,A,2015136098), focusing upon design of the spark plug boot, also disclose a bendable extension device between the ignition coil and the spark terminal plug, using an elastomeric shielding tube and an electrical conductor in form of a cable wire or wires inside said tube in order to enable bending of the extension device, and coil springs for connecting the cable wire ends to the ignition plug and the ignition coil.

DISCLOSURE OF THE INVENTION

It has surprisingly been found that the design of the long electrical conductor in the extension body could cause corona effects, which ultimately could cause short circuiting of the extension body. As soon as there are layers of air around electrical conductors transmitting high voltage, partial discharge will occur through these layers of air resulting in losses in ignition energy and decrease in lifetime of the electrical conductor. These partial discharges through the air layers may cause degradation of spark plug insulator and conductor material due to heat release and ozone formation and may also build up short circuiting carbon deposits. It is thus found to be essential that air layers around the electrical conductor are eliminated or at least minimized.

The cause to these partial discharges is due to different dielectric constant in the different materials used in the spark plug and the extension body, including air layers which per se has the lowest dielectric constant, leading to high strength of the electrical field in these air layers. Unfortunately have the air layers also the lowest dielectric strength, i.e. resistance against flash over. The combination with location of the highest filed strength and lowest resistance against flash over in air gaps creates these partial discharges. Even if the current is low in these partial discharges they occur frequently during almost every single ignition event.

The effect with partial discharges through air layers is particularly seen in conductors with one extended coil spring or multiple conducting wires located in an air filled channel at the center of the spark plug or at the center of the extension body.

It is an object of the present invention to solve, or at least to minimise the above mentioned problems with partial discharge through layers of air, increasing the expected MTBF (mean time between failure) of the ignition coil assembly and especially the extension body between the ignition coil and the spark plug.

The invention is related to a spark plug extension body connecting an ignition coil with a spark plug comprising a spark plug boot, an extension housing and an ignition coil connector. Said spark plug extension body has a main axis and is configured for insertion into and/or removal out of a well associated with an spark ignited internal combustion engine. Said spark plug extension body comprises an elongated extension housing with at least an electrical conductor and an electrical insulator arranged around the electrical conductor. Said extension body comprising an upper ignition coil connector connectible to an ignition coil terminal and a lower spark plug boot connectable to the spark plug. According to the invention is the entire electrical conductor in a rod like form and at least both ends of the electrical conductor are made as a monolith in a flexible and electrically conducting polymeric material. Solid monoliths of flexible and electrically conductive polymeric material solves the problem with prior art problems with Corona effects in coil spring contacts, while still being able to provide with a positive clamping force in the electrically contact points, that is necessary in the vibration environment of a combustion engine. Hence, a spark plug extension body with longer MTBF is obtained, saving operational costs for spare parts of the operator and increased availability of the combustion engine.

In a preferred embodiment of the invention is at least a part of the electrical conductor made in a solid rod like form.

Preferably is at least a part of the electrical conductor made in a tubular rod like form. Both the solid rod or tubular rod may be obtained from standard production lines, not requiring tailor made production lines, thus reducing costs considerably.

In a preferred embodiment may the entire length of the electrical conductor be made as a monolith in a flexible and electrically conducting polymeric material. Besides reduction on electrical contact points, that may cause flashover and burns during lengthy operations, could costs for the spark plug connector be reduced even further.

In a further embodiment are also at least both ends of the electrical conductor made in an electrically conductive rubber material. Preferably but not limited to, may the electrically conductive rubber material be selected from any of graphite rubber,
nickel-graphite rubber,
silver-copper-rubber, or
silicone rubber.

And may preferably be made by an extrusion or die moulding forming process.

In an alternative embodiment are also at least both ends of the electrical conductor made in an electrically conductive thermoplastic material or thermoplastic elastomer material. Preferably but not limited to, may the electrically conductive thermoplastic material be selected from any of electrically non-conductive matrix material and an electrically conductive filler part which contains metal, or
electrically non-conductive matrix material and an electrically conductive filler part which contains carbon powder, carbon black or carbon fibers;

And may preferably be made by an extrusion or die moulding forming process.

In order to completely avoid local short circuiting may the electrical conductor in the centre of the elongated extension body fill the centre volume completely. The electrical conductor may also be vulcanized to, or otherwise fused to, the surrounding insulator, avoiding any air layers around the electrical conductor.

The inventive spark plug extension body has a first electrical connector in the upper end portion for connecting to an ignition coil contact and in the lower end portion has a second electrical end connector for the spark plug terminal, wherein said first and second end connectors are integral parts of the electrical conductor.

According to an alternative detail embodiment may also at least one end connector be a cylindrical sleeve made by the electrically conducting polymeric material, with the sleeve arranged concentric with at least the ignition coil terminal and/or the spark plug terminal connected thereto. The internal diameter of the cylindrical sleeve, before mounting the sleeve on an ignition coil terminal or a spark plug terminal, is preferably smaller than the outer diameter of ignition coil terminal or the spark plug terminal.

Alternatively may at least one end connector be equipped with a slotted cylindrical metal sleeve, with the sleeve arranged concentric with at least the ignition coil terminal or the spark plug terminal connected thereto and with the sleeve mounted in the end connector.

Overall, said electrical conductor of the spark plug extension body preferably has a length that is between 100-500 mm, preferably at least 150 mm.

In a special embodiment may also the electrical conductor as well as the electrical insulator be made by flexible material, wherein the extension body is arranged to be transversally bendable in relation to the main axis so that the upper end portion and the lower end portion may assume an angle in relation to each other. This allows also conversion of diesel engines to natural gas engines with spark plugs, where the diesel engine has not been designed with mounting faces for an ignition coil housing, and therefore requires a mounting position well off from a straight line to the spark plug installed.

The invention also relates to a method for reduction of partial electrical discharges in a spark plug extension body comprising the steps of providing the extension body with an electrical conductor and an electrical insulator arranged around the electrical conductor, providing an upper ignition coil connector connectible to an ignition coil terminal and a lower spark plug boot connectable to the spark plug in said extension body characterized in providing further an electrical conductor in a rod like form with at least both ends of the electrical conductor made as a monolith in a flexible and electrically conducting polymeric material, and without air radial air gaps between the electrical conductor and the surrounding electrical insulator.

The invention is primarily intended for reduction of partial discharges in air gaps around the central conductor in the extension body, but some partial discharge may also occur in the well of the combustion engine cylinder head between the insulator and the surrounding grounded cylinder head. If a layer of electrically conductive material is applied on the outer surface of the extension body may also partial discharges be reduced in these areas, eroding the insulator over time. Therefore is the electrical insulator of the spark plug extension body covered on the outer surface facing the cylinder head around the well, with an electrically conducting cover, preferably a thin layer of an electrically conducting polymeric material. This layer most of course be well grounded with the grounded parts of the combustion engine, which may be done by physical contact in the lower end with the grounded parts of the spark plug or alternatively trough physical contact with the cylinder head via ignition coil fastening means in the upper end.

DETAILED DESCRIPTION

The invention will hereinafter be described in more detail with reference to the appended drawings. The following description should be considered as preferred form only, and is not decisive in a limiting sense.

First Embodiment

Figure 1A:
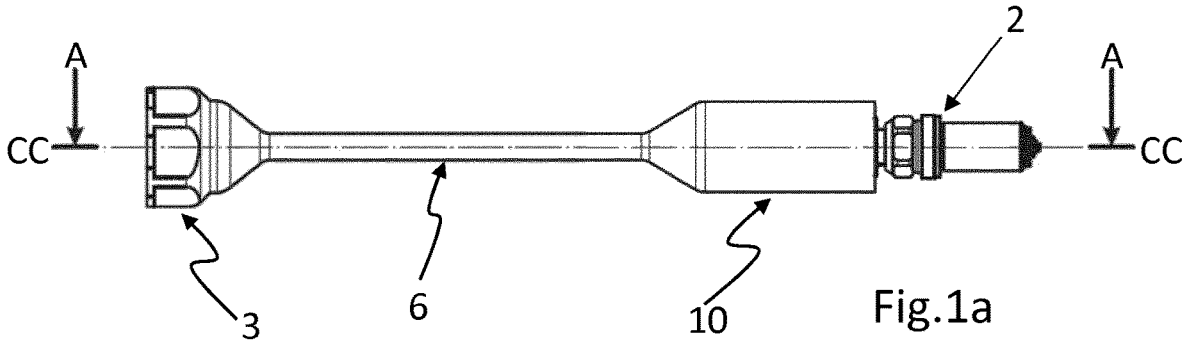
FIG. 1*a* is a side view of a spark plug extension body according to a first embodiment of the invention.
Figure 1B:
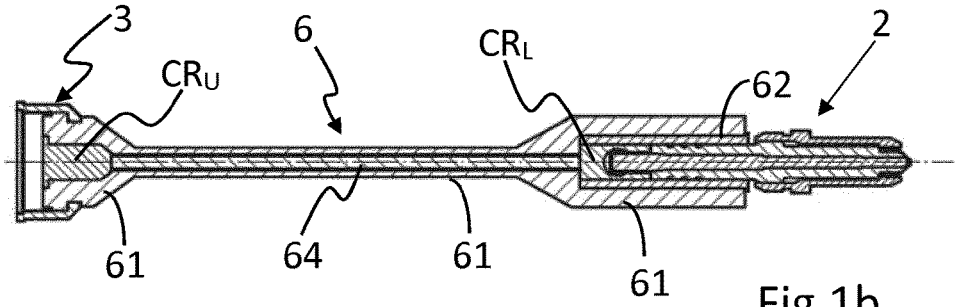
FIG. 1*b* is a cross sectional view of the spark plug extension body as seen in view A-A in FIG. 1*a;*
Figure 1C:
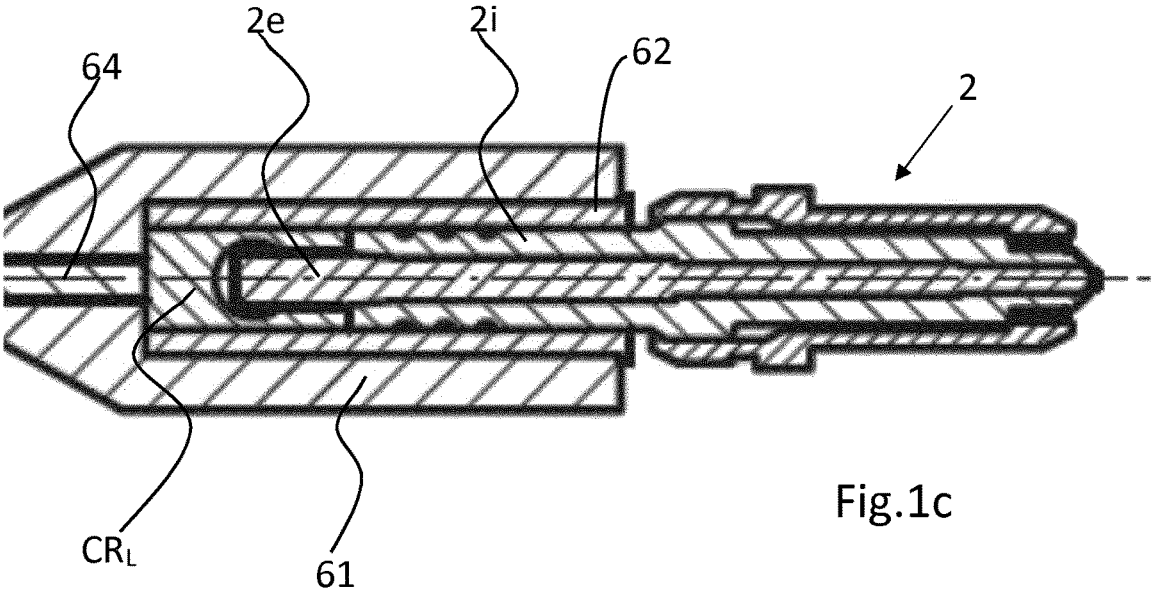
FIG. 1*c* is an enlarged detail view of the spark plug boot om FIG. 1*b;*

In FIG. 1*a* is shown a side view of a first embodiment of a spark plug extension body according to the invention, and FIG. 1*b* shows a cross section of the spark plug extension body as seen in view A-A in FIG. 1 through the main axis CC. FIG. 1*c* shows an enlarged view of the spark plug boot in FIG. 1.*b*.

The main parts of the spark plug extension body comprise a spark plug boot 10, an upper ignition coil connector 3 connectible to an ignition coil and an elongated extension housing 6.

The spark plug extension body is configured for insertion in a well of a cylinder head in a conventional manner which well is associated with an internal combustion engine.

The spark plug boot 10 and the coil connector 3 are connected to each other by means of the elongated extension housing 6 which comprises an inner conductor 64.

In this first embodiment the inner conductor 64 may be any suitable conductor material, in form of a flexible or solid homogenous conductor.

According to the invention at least both ends $CR_U$ and $CR_L$ of the electrical conductor 64 are made as a monolith in a flexible and electrically conducting polymeric material. Thus, the upper end element $CR_U$ and the lower end element $CR_L$ are preferably made as a solid body of electrically conductive material, more preferably electrically conductive rubber material. $CR_U$ and $CR_L$ may be die moulded with a recess for the spark plug terminal 2*e* in the lower end element $CR_L$.

The flexible upper end element $CR_U$ and the lower flexible end element $CR_L$ both provides for a positive bias force in the connecting points to the terminal 2*e* of the spark plug and the coil terminal (not shown) that may have a protruding pin that penetrates into the upper end element $CR_U$ when mounting the coil connector 3 to the ignition coil. The coil connector 3 may as seen in FIGS. 1*a* and 1*b* comprise a metallic or sturdy sleeve which may have surfaces for applying a spanner, and with internal threads that may be tightened to corresponding threads on the ignition coil housing.

Further, the entire spark plug extension body may be provided with an outer electrically insulating housing 61 that may be casted thermoplastic material or similar, stretching all the way from the coil connector 3 and to the lower end of the spark plug boot 10. An elastic electrically insulating rubber sleeve 62 may also be provided for sealing the gap between the lower end of the boot 10 and the ceramic insulator 2*i* of the spark plug.

Depending upon if the spark plug extension body needs to be flexible or not is the material of the insulating housing 61 and the inner conductor 64 chosen.

Second Embodiment

Figure 2A:
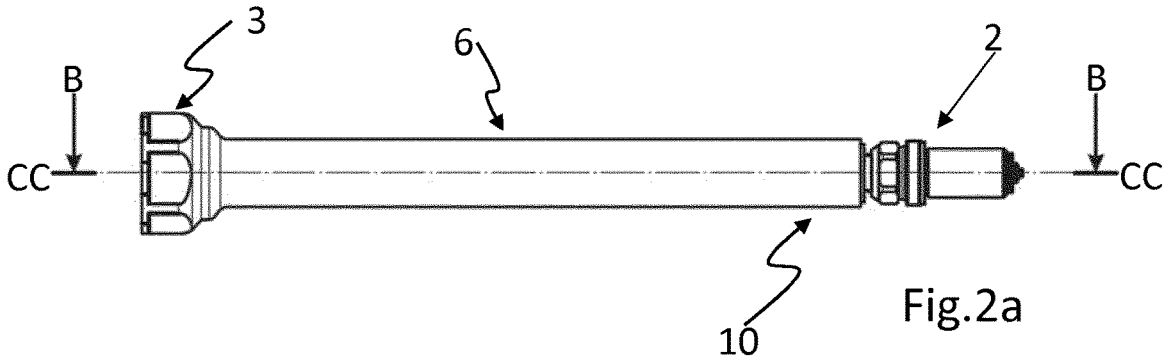
FIG. 2*a* is a side view of a spark plug extension body according to a second embodiment of the invention.
Figure 2B:
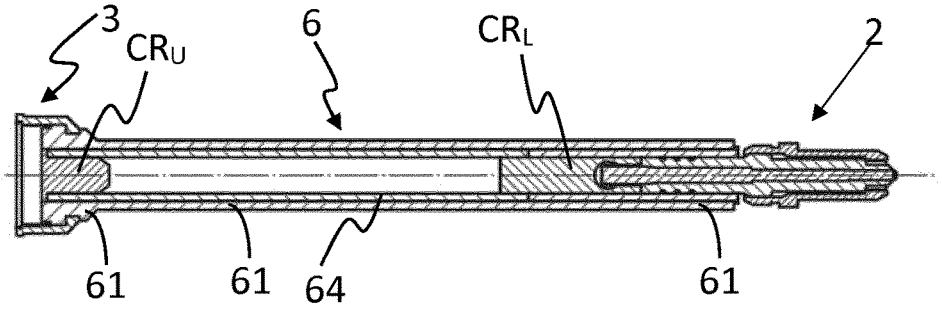
FIG. 2*b* is a cross sectional view of the spark plug extension body as seen in view B-B in FIG. 2*a;*
Figure 2C:
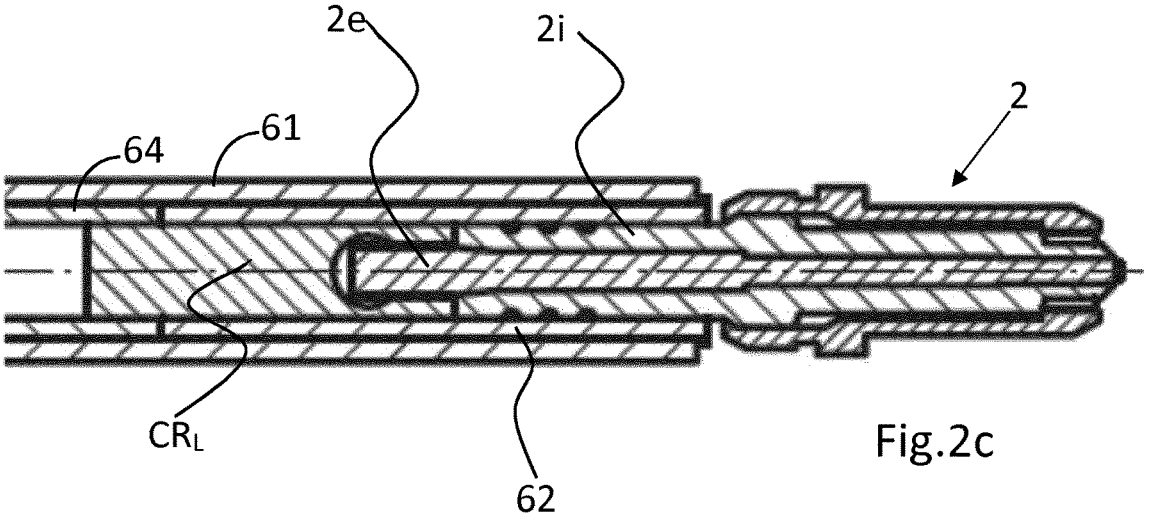
FIG. 2*c* is an enlarged detail view of the spark plug boot om FIG. 2*b;*

In FIG. 2*a* is shown a side view of a second embodiment of a spark plug extension body according to the invention, and FIG. 2*b* shows a cross section of the spark plug extension body as seen in view B-B in FIG. 2 through the main axis CC. FIG. 2*c* shows an enlarged view of the spark plug boot in FIG. 2*b*.

The main parts of the spark plug extension body comprise a spark plug boot 10, an upper ignition coil connector 3 connectible to an ignition coil and an elongated extension housing 6.

As in the first embodiment are the spark plug boot 10 and the coil connector 3 connected to each other by means of the elongated extension housing 6 which comprises an inner conductor 64.

In this second embodiment the inner conductor 64 may be any suitable conductor material, in form of a flexible or solid homogenous conductor, but here shaped as a hollow tube. This tube may or may not be void of any filler in the centre, or have a filling rod of any suitable filler material. The tube may also have a coil spring embedded in the tube material or have a supporting coil spring on the inside of the tube.

According to the invention at least both ends $CR_U$ and $CR_L$ of the electrical conductor 64 are made as a monolith in a flexible and electrically conducting polymeric material. Thus, the upper end element $CR_U$ and the lower end element $CR_L$ are preferably made as a solid body of electrically conductive material, more preferably electrically conductive rubber material. $CR_U$ and $CR_L$ may be die moulded with a recess for the spark plug terminal 2*e* in the lower end element $CR_L$.

The flexible upper end element $CR_U$ and the lower flexible end element $CR_L$ both provides for a positive bias force in the connecting points to the terminal 2*e* of the spark plug and the coil terminal (not shown), which coil terminal may have a protruding pin that penetrates into the upper end element $CR_U$ when mounting the coil connector 3 to the ignition coil.

The coil connector 3 may as seen in FIGS. 2*a* and 2*b* comprise a metallic or sturdy sleeve which may have surfaces for applying a spanner, and with internal threads that may be tightened to corresponding threads on the ignition coil housing.

Further, the entire spark plug extension body may be provided with an outer electrically insulating housing 61 that may be casted thermoplastic material or similar, stretching all the way from the coil connector 3 and to the lower end of the spark plug boot 10. An elastic electrically insulating rubber sleeve 62 may also be provided for sealing the gap between the lower end of the boot 10 and the ceramic insulator 2*i* of the spark plug.

Depending upon if the spark plug extension body needs to be flexible or not is the material of the insulating housing 61 and the inner conductor 64 chosen.

Third Embodiment

Figure 3A:
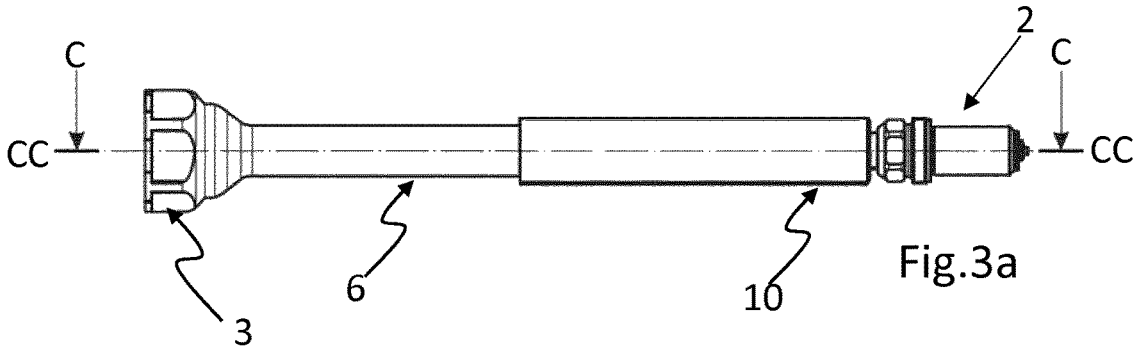
FIG. 3*a* is a side view of a spark plug extension body according to a second embodiment of the invention.
Figure 3B:
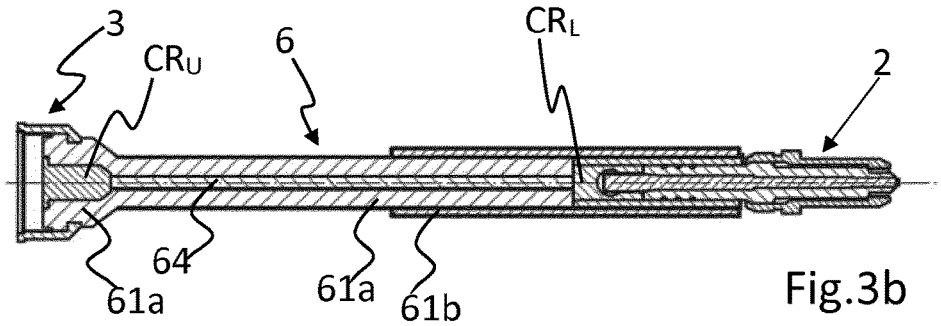
FIG. 3*b* is a cross sectional view of the spark plug extension body as seen in view C-C in FIG. 3*a;*
Figure 3C:
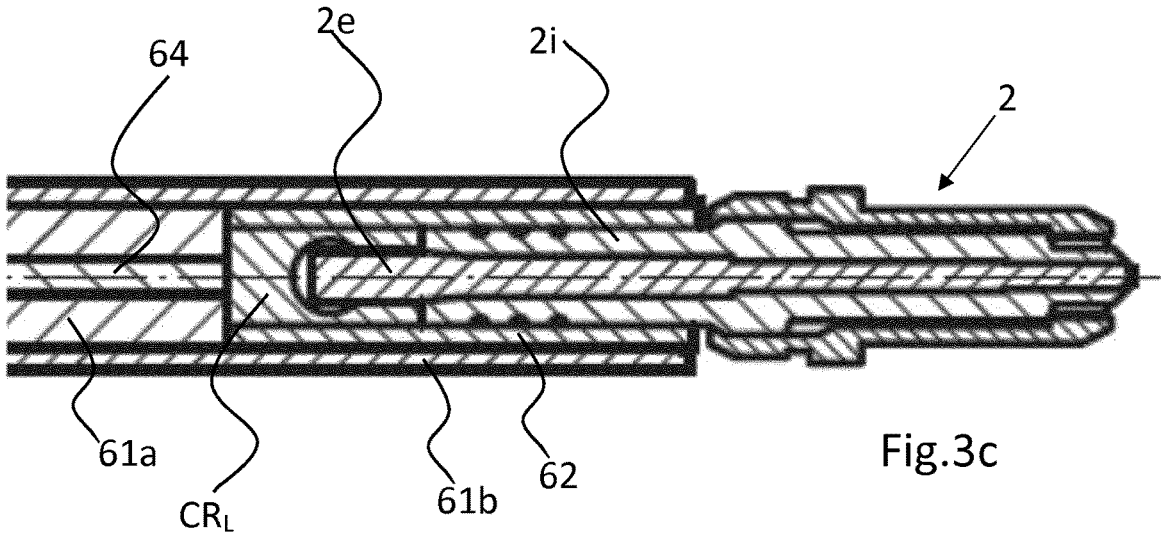
FIG. 3*c* is an enlarged detail view of the spark plug boot in FIG. 3*b;*

In FIG. 3*a* is shown a side view of a third embodiment of a spark plug extension body according to the invention, and FIG. 3*b* shows a cross section of the spark plug extension body as seen in view C-C in FIG. 3*a* through the main axis CC. FIG. 3*c* shows an enlarged view of the spark plug boot 10 in FIG. 3*b*.

The main parts of the spark plug extension body comprises as in previous embodiments of a spark plug boot 10, an upper ignition coil connector 3 connectible to an ignition coil and an elongated extension housing 6.

The spark plug boot 10 and the coil connector 3 are connected to each other by means of the elongated extension housing 6 which comprises an inner conductor 64.

In this third embodiment the inner conductor 64 may be any suitable conductor material, in form of a flexible or solid homogenous conductor.

According to the invention at least both ends $CR_U$ and $CR_L$ of the electrical conductor 64 are made as a monolith in a flexible and electrically conducting polymeric material. Thus, the upper end element $CR_U$ and the lower end element $CR_L$ are preferably made as a solid body of electrically conductive material, more preferably electrically conductive rubber material. $CR_U$ and $CR_L$ may be die moulded with a recess for the spark plug terminal 2*e* in the lower end element $CR_L$.

The flexible upper end element $CR_U$ and the lower flexible end element $CR_L$ both provides for a positive bias force in the connecting points to the terminal 2*e* of the spark plug and the coil terminal (not shown) which coil terminal may have a protruding pin that penetrates into the upper end element $CR_U$ when mounting the coil connector 3 to the ignition coil.

The coil connector 3 in the upper end may as seen in FIGS. 3*a* and 3*b* comprise a metallic or sturdy sleeve which may have surfaces for applying a spanner, and with internal threads that may be tightened to corresponding threads on the ignition coil housing.

Further, the entire spark plug extension body may be provided with an outer electrically insulating housing in two parts 61*a* and 61*b* respectively that may be casted thermoplastic material or similar, which together are stretching all the way from the coil connector 3 and to the lower end of the spark plug boot 10. The upper part of the insulating housing 61*a* covers the coil connector 3 and a larger part of the elongated housing 61*a* and 61*b*, and may preferably be made in a flexible material allowing the extension body to be bent. The lower part 61*b* of the insulating housing covers the plug boot 10 and only a smaller part, at the most 50% of the length, of the elongated housing 61*a* and 61*b*.

An elastic electrically insulating rubber sleeve 62 may also be provided for sealing the gap between the lower end of the boot 10 and the ceramic insulator 2*i* of the spark plug.

Depending upon if the spark plug extension body needs to be flexible or not is the material of the insulating housing 61 and the inner conductor 64 chosen.

Fourth embodiment

Figure 4A:
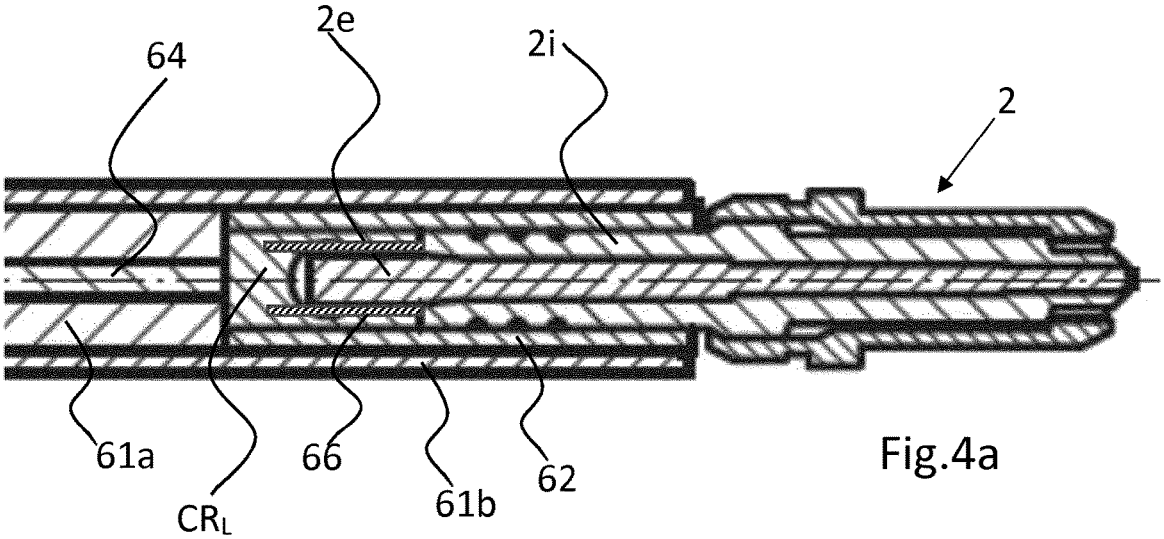
FIG. 4*a* is an enlarged detail view of the spark plug boot according to an alternative inventive embodiment.

In FIG. 4*a* is shown an alternative detail embodiment, which otherwise have all other details similar to the third embodiment. Here is the lower flexible end element $CR_L$ also equipped with a slotted cylindrical metal sleeve 66, with the sleeve arranged concentric with the spark plug terminal 2*e* connected thereto and with the sleeve mounted by press fitting on the exterior of the lower flexible end element $CR_L$. The slot 66*a* allows the sleeve 66 to expand when mounting on top of the spark plug terminal 2*e*, and the inner diameter of the sleeve has a diameter slightly less than the outer diameter of the spark plug terminal 2*e*, typically by 0.1-1 mm. Also in this embodiment may the end face of the ignition plug terminal 2*e* come into abutting contact with the lower flexible end element $CR_L$, avoiding any air pockets therebetween.

Fifth Embodiment

Figure 4B:
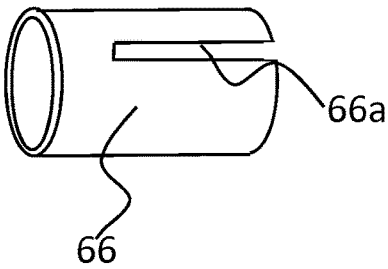
FIG. 4*b* is a detail view of the end connector 66 seen in FIG. 4*a*, and FIG. 5 showing an alternative design of the electrical conductor 64.
Figure 5:
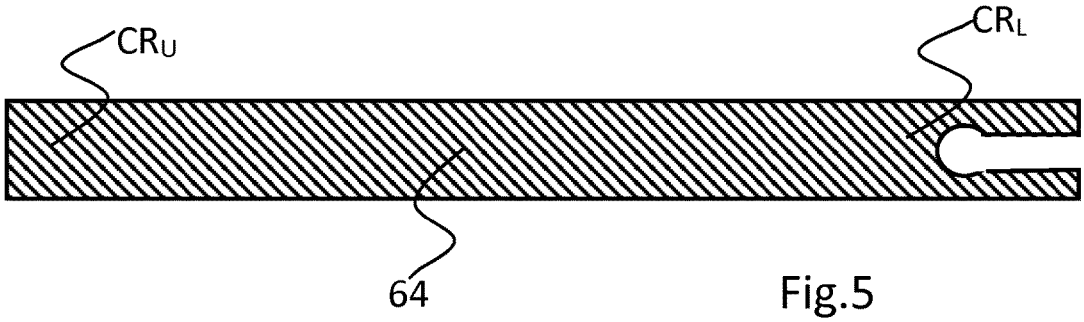

In FIG. 5 is shown yet an alternative detail embodiment, where not only the ends $CR_U$ and $CR_L$ of the electrical conductor 64 are made as a monolith in a flexible and electrically conducting polymeric material but instead the entire electrical conductor, with the ends $CR_U$ and $CR_L$ as well as the intermediate connector 64 all made in the same material, and thus forms one single monolith body of electrically conducting polymeric material. As seen here is the lower flexible end part $CR_L$ equipped with a recess for the spark plug terminal in the same way as in embodiments shown in FIG. 1-3, but may also have an end like the embodiment shown in FIG. 4.

SUMMARY

The spark plug extension body according the invention provides with a solution avoiding usage of the conventional coil springs that are used to establish electrical contact with the spark plug terminal and/or the ignition coil terminal. The risk of corona effects in these coil springs is radically reduced and the spark plug extension body obtains an extended MTBF and thus saves operating costs and increased operability of the spark ignited engine.

The invention is not to be seen as limited by the embodiments described above, but can be varied within the scope of the appended claims. For instance, the flexible material of the extension body may be a material other than rubber, and further the extension body may vary in length depending on the depth of the well 90.

Many other variations are also possible, as will be readily understood by the person skilled in the art.

The invention claimed is:

1. A spark plug extension body connecting an ignition coil with a spark plug comprising:

a spark plug boot;

an extension housing; and an ignition coil connector;

wherein said spark plug extension body includes a main axis and is configured for insertion into and/or removal out of a well associated with an internal combustion engine;

wherein an elongated portion of the extension housing includes at least an electrical conductor and an electrical insulator arranged around the electrical conductor, wherein an upper portion of the ignition coil connector is removably connected to an ignition coil terminal, wherein a lower portion of the spark plug boot is removably connected to the spark plug, and wherein the electrical conductor is in a rod like form, the electrical conductor has a length that is between 100-500 mm, and at least both ends of the electrical conductor are made as a monolith in a flexible and electrically conducting polymeric material.

2. spark plug extension body according to claim 1, wherein at least a part of the electrical conductor is made in a solid rod like form.

3. A spark plug extension body according to claim 1, wherein at least a part of the electrical conductor is made in a tubular rod like form.

4. A spark plug extension body according to claim 1, wherein an entire length of the electrical conductor is made as a monolith in a flexible and electrically conducting polymeric material.

5. A spark plug extension body according to claim 1, wherein at least both ends of the electrical conductor are made in an electrically conductive rubber material.

6. A spark plug extension body according to claim 5, wherein the electrically conductive rubber material is selected from any of graphite rubber, nickel-graphite rubber, silver-copper-rubber or silicone rubber, and made by an extrusion or die moulding forming process.

7. A spark plug extension body according to claim 1, wherein the electrical conductor is located in a center of the elongated portion of the extension body completely filling a center volume.

8. A spark plug extension body according to claim 1, wherein an upper end portion of the electrical conductor includes a first end connector for connecting to an ignition coil terminal, and wherein a lower end portion of the electrical conductor includes a second end connector for a spark plug terminal, wherein the first and second ends are integral parts of the electrical conductor.

9. A spark plug extension body according to claim 8, wherein at least one end connector is a cylindrical sleeve made by the electrically conducting polymeric material, and wherein the cylindrical sleeve is arranged concentric with at least the ignition coil terminal or the spark plug terminal connected thereto and with an internal diameter of the cylindrical sleeve, before mounting the cylindrical sleeve on an ignition coil contact or the spark plug terminal, smaller than an outer diameter of the ignition coil terminal or the spark plug terminal.

10. The A spark plug extension body according to claim 8, wherein at least one end connector is a slotted cylindrical metal sleeve, wherein the slotted cylindrical sleeve is arranged concentric with at least an ignition coil contact or the spark plug terminal connected thereto and with the slotted cylindrical sleeve mounted by press fitting on an exterior of a lower flexible end element.

11. The spark plug extension body according to claim 1, wherein the electrical conductor as well as the electrical insulator are made by a flexible material, wherein the extension body is arranged to be transversally bendable in relation to the main axis so that an upper end portion and a lower end portion of the extension body may assume an angle (a) in relation to each other.

12. The spark plug extension body according to claim 1, wherein the electrical insulator is covered on an outer surface facing the a cylinder head around the well with an electrically conducting cover including a thin layer of an electrically conducting polymeric material.

13. The A method for reduction of partial electrical discharges in a spark plug extension body comprising: providing the spark plug extension body with an electrical conductor including a length that is between 100-500 mm, and an electrical insulator arranged around the electrical conductor; providing an upper ignition coil connector to an ignition coil terminal and a lower spark plug boot connectable to the spark plug in the spark plug extension body; and wherein the electrical conductor is provided in a rod like form with at least both ends of the electrical conductor made as a monolith in a flexible and electrically conducting polymeric material, and without air radial air gaps between the electrical conductor and a surrounding of the electrical insulator; wherein the electrical conductor is in a rod like form, the electrical conductor has a length that is between 100-500 mm, and at least both ends of the electrical conductor are made as a monolith in a flexible and electrically conducting polymeric material.

14. The method of claim 13, wherein the electrical conductor has a length that is at least 150 mm.

15. The spark plug extension body according to claim 1, wherein the electrical conductor has a length that is at least 150 mm.

* * * * *